US009246281B1

(12) United States Patent
Edmunds et al.

(10) Patent No.: US 9,246,281 B1
(45) Date of Patent: Jan. 26, 2016

(54) RECEPTACLE/PLUG ASSEMBLY

(71) Applicants: Wayne Edmunds, Apollo Beach, FL (US); Stanley Adams, Knoxville, TN (US)

(72) Inventors: Wayne Edmunds, Apollo Beach, FL (US); Stanley Adams, Knoxville, TN (US)

( * ) Notice: Subject to any disclaimer, the term of this patent is extended or adjusted under 35 U.S.C. 154(b) by 0 days.

(21) Appl. No.: 14/329,495

(22) Filed: Jul. 11, 2014

Related U.S. Application Data

(60) Provisional application No. 61/845,574, filed on Jul. 12, 2013.

(51) Int. Cl.
*H01R 13/64* (2006.01)
*H01R 24/20* (2011.01)

(52) U.S. Cl.
CPC ..... *H01R 24/20* (2013.01)

(58) Field of Classification Search
CPC .. H01R 13/64; H01R 13/652; H01R 23/7005; H01R 13/629; H01R 13/6456; H01R 2103/00
See application file for complete search history.

(56) References Cited

U.S. PATENT DOCUMENTS

| | | | | |
|---|---|---|---|---|
| 4,403,824 | A * | 9/1983 | Scott | 439/680 |
| 7,121,899 | B2 * | 10/2006 | Homann et al. | 439/680 |
| 8,011,975 | B1 * | 9/2011 | Kim et al. | 439/680 |
| 2003/0109180 | A1 * | 6/2003 | Mueller | 439/680 |
| 2005/0054243 | A1 * | 3/2005 | Adams et al. | 439/680 |

* cited by examiner

*Primary Examiner* — Gary Paumen

(57) ABSTRACT

An authorized electrical plug has a plug surface with first and second plug edges and left and right side plug edges. The plug surface has left and right prongs projecting outwardly from the plug surface. A recess has a depth formed in the plug surface. An authorized electrical receptacle has a receptacle surface with first and second receptacle edges, left and right side receptacle edges, and left and right slots extending inwardly. A projection has a height formed in the receptacle surface. Left and right slots receive the left and right prongs respectively with the recess receiving the projection when an authorized electrical receptacle receives an authorized electrical plug.

2 Claims, 3 Drawing Sheets

RECEPTACLE/PLUG ASSEMBLY

RELATED APPLICATION

This application is based upon and claims priority of Provisional Application No. 61/845,574 filed Jul. 12, 2013, the subject matter of which is incorporated herein by reference.

BACKGROUND OF THE INVENTION

1. Field of the Invention

The present invention relates to a receptacle/plug assembly and more particularly pertains to coupling authorized electrical devices to particular sources of electrical potential while prohibiting the coupling of unauthorized electrical devices to the particular sources of electrical potential, the coupling and the prohibiting being done in a safe, convenient, and economical manner.

2. Description of the Prior Art

The use of receptacle/plug assemblies of known designs and configurations is known in the prior art. More specifically, receptacle/plug assemblies of known designs and configurations previously devised and utilized for the purpose of conducting electrical energy are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe receptacle/plug assembly that allows coupling authorized electrical devices to particular sources of electrical potential while prohibiting the coupling of unauthorized electrical devices to the particular sources of electrical potential, the coupling and the prohibiting being done in a safe, convenient and economical manner.

In this respect, the receptacle/plug assembly according to the present invention substantially departs from the conventional concepts and designs of the prior art, and in doing so provides an apparatus primarily developed for the purpose of coupling authorized electrical devices to particular sources of electrical potential while prohibiting the coupling of unauthorized electrical devices to the particular sources of electrical potential, the coupling and the prohibiting being done in a safe, convenient and economical manner.

Therefore, it can be appreciated that there exists a continuing need for a new and improved receptacle/plug assembly which can be used for coupling authorized electrical devices to particular sources of electrical potential while prohibiting the coupling of unauthorized electrical devices to the particular sources of electrical potential, the coupling and the prohibiting being done in a safe, convenient and economical manner. In this regard, the present invention substantially fulfills this need.

SUMMARY OF THE INVENTION

In view of the disadvantages inherent in the known types of plug assemblies of known designs and configurations now present in the prior art, the present invention provides an improved receptacle/plug assembly. As such, the general purpose of the present invention, which will be described subsequently in greater detail, is to provide a new and improved receptacle/plug assembly and method which has all the advantages of the prior art and none of the disadvantages.

To attain this, in its broadest context, the present invention essentially comprises an authorized electrical plug and an authorized electrical receptacle. In this broad context, first provided is an authorized electrical plug. The electrical plus has a plug surface. The plug surface has first and second plug edges and left and right side plug edges. The plug surface has left and right prongs projecting outwardly from the plug surface. A recess has a depth formed in the plug surface. Provided next is an authorized electrical receptacle. The electrical receptacle has a receptacle surface. The receptacle surface has first and second receptacle edges. The receptacle surface has left and right side receptacle edges. The receptacle surface has left and right slots extending inwardly from the receptacle surface. A projection has a height formed in the receptacle surface. Left and right slots are provided. The slots are adapted to receive the left and right prongs respectively with the recess receiving the projection when an authorized electrical receptacle receives an authorized electrical plug. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved receptacle/plug assembly which has all of the advantages of the prior art receptacle/plug assemblies of known designs and configurations and none of the disadvantages.

It is another object of the present invention to provide a new and improved receptacle/plug assembly which may be easily and efficiently manufactured and marketed.

It is further object of the present invention to provide a new and improved receptacle/plug assembly which is of durable and reliable constructions.

An even further object of the present invention is to provide a new and improved receptacle/plug assembly which is susceptible of a low cost of manufacture with regard to both materials and labor, and which accordingly is then susceptible of low prices of sale to the consuming public, thereby making such receptacle/plug assembly economically available to the buying public.

Lastly, another object of the present invention is to provide a receptacle/plug assembly for coupling authorized electrical devices to particular sources of electrical potential while prohibiting the coupling of unauthorized electrical devices to the particular sources of electrical potential, the coupling and the prohibiting being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

The same reference numerals refer to the same parts throughout the various Figures.

DESCRIPTION OF THE PREFERRED EMBODIMENT

Figure 1:
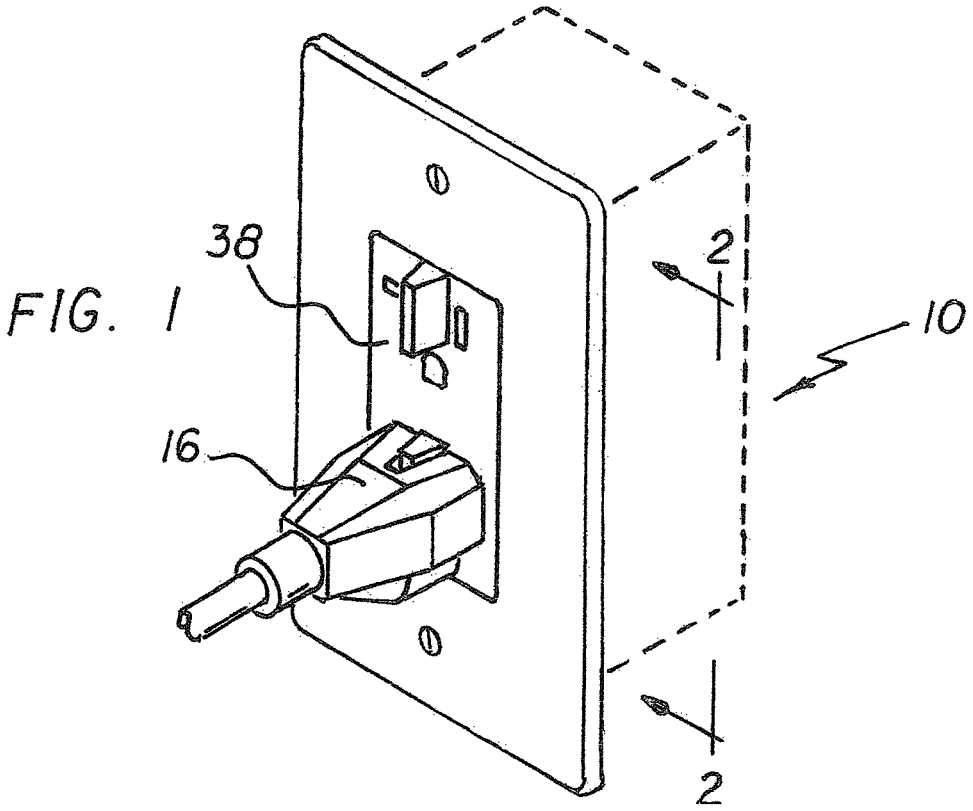
FIG. 1 is a perspective illustration of a receptacle/plug assembly constructed in accordance with the principles of the present invention.
Figure 2:
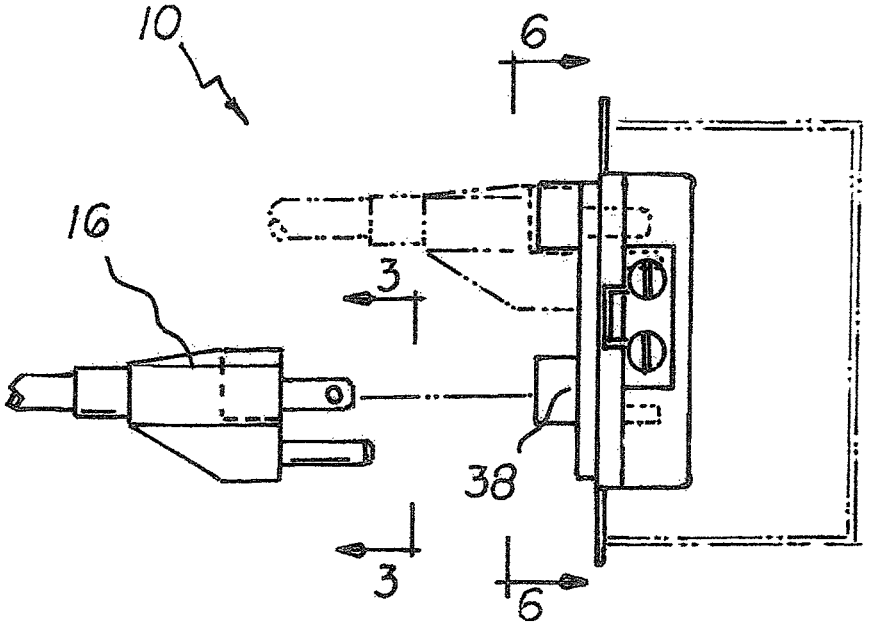
FIG. 2 is a side elevational view taken along line 2-2 of FIG. 1.
Figure 3:
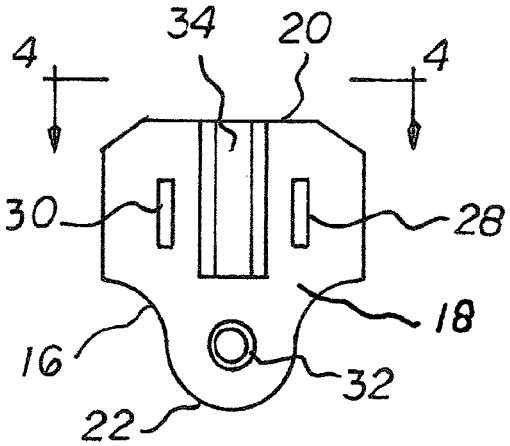
FIG. 3 is a front elevational view taken along line 3-3 of FIG. 2.
Figure 4:
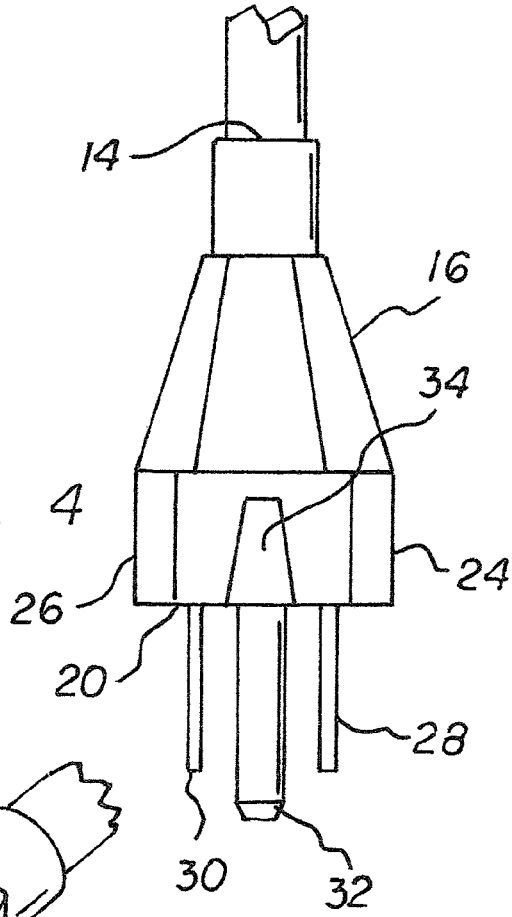
FIG. 4 is a plan view taken along line 4-4 of FIG. 3.
Figure 5:
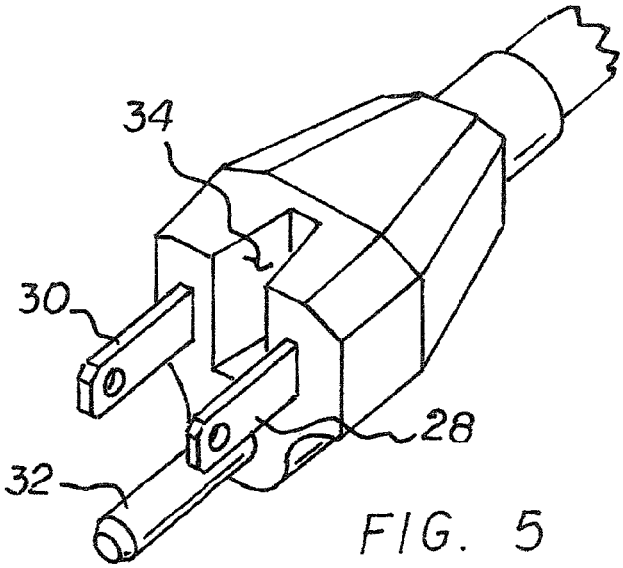
FIG. 5 is a perspective illustration of the plug of FIGS. 1-4.
Figure 6:
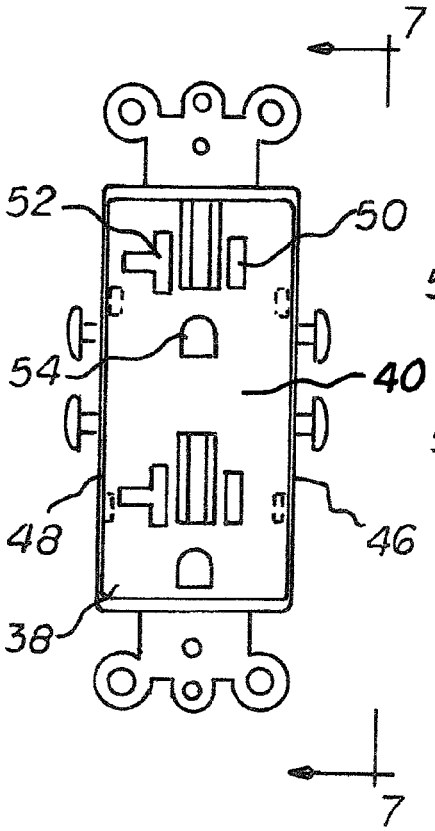
FIG. 6 is a front elevational view taken along line 6-6 of FIG. 2.
Figure 7:
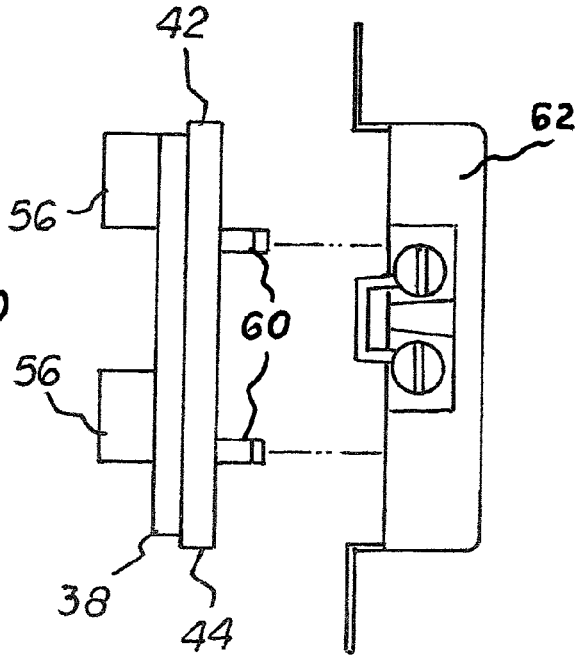
FIG. 7 is a front elevational view taken along line 7-7 of FIG. 2.
Figure 8:
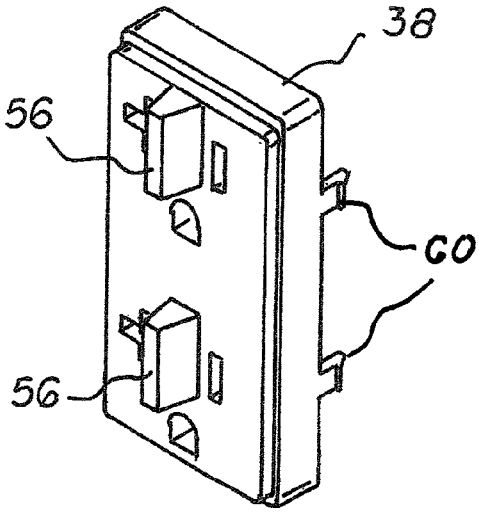
FIG. 8 is a perspective illustration of the receptacle of FIGS. 6-7.

With reference now to the drawings, and in particular to FIG. 1 thereof, the preferred embodiment of the new and improved receptacle/plug assembly embodying the principles and concepts of the present invention and generally designated by the reference numeral 10 will be described.

The present invention, the receptacle/plug assembly 10 is comprised of a plurality of components. Such components are individually configured and correlated with respect to each other so as to attain the desired objective.

In the preferred embodiment of the receptacle/plug assembly, designated by reference numeral 10, first provided is an authorized electrical plug. The electrical plus has a plug surface. The plug surface has first and second plug edges and left and right side plug edges. The plug surface has left and right prongs projecting outwardly from the plug surface. A recess has a depth formed in the plug surface.

An authorized electrical receptacle is provided. The electrical receptacle has a receptacle surface. The receptacle surface has first and second receptacle edges. The receptacle surface has left and right side receptacle edges. The receptacle surface has left and right slots extending inwardly from the receptacle surface. A projection has a height formed in the receptacle surface.

Left and right slots are provided. The slots are adapted to receive the left and right prongs respectively with the recess receiving the projection when an authorized electrical receptacle receives an authorized electrical plug.

The projection is located between the slots. The projection has a first length. The prongs have an essentially equal second length. The depth and the height and the first and second lengths are essentially the same plus or minus 20 percent. In this manner an unauthorized electrical plug will be unable to insert its prongs into the slots of an authorized receptacle for conducting current through the prongs.

An authorized electrical device, not shown, has an electrical line 14. The electrical line has a terminal end. An authorized electrical plug 16 is provided. The authorized electrical plug is provided at the terminal end of the electrical line. The authorized electrical plug has a plug surface 18. The plug surface has a first plug edge 20. The plug surface has a longitudinally spaced second plug edge 22. The plug surface has a left side plug edge 24. The left side plug edge has a laterally spaced right side plug edge 26. The plug surface is in a generally planar configuration. A left prong 28 is provided. The left prong projects outwardly from the plug surface adjacent to and parallel with the left side plug edge in proximity to the first plug edge. A right prong 30 is provided. The right prong projects outwardly from the plug surface adjacent to and parallel with the right side plug edge in proximity to the first plug edge. A cylindrical grounding prong 32 is provided. The grounding prong projects outwardly from the plug surface equally spaced from the left side plug edge and the right side plug edge in proximity to the second plug edge. The plug surface has a trapezoidal recess 34. The recess is formed intermediate the left and right plugs laterally. The recess extends longitudinally from the first plug edge to adjacent to the grounding plug.

An authorized electrical receptacle 38 is provided. The authorized electrical receptacle is operatively coupled to a source of electrical potential, not shown. The authorized electrical receptacle has a receptacle surface 40. The receptacle surface has a first receptacle edge 42. The receptacle surface has a longitudinally spaced second receptacle edge 44. The receptacle surface has a left side receptacle edge 46. The receptacle surface has a laterally spaced right side receptacle edge 48. The receptacle surface has a generally planar configuration. The receptacle surface has a left slot 50. The left slot extends inwardly from the receptacle surface adjacent to and parallel with the left side receptacle edge in proximity to the first receptacle edge. The receptacle surface has a right slot 52. The right slot extends inwardly from the receptacle surface adjacent to and parallel with the right side receptacle edge remote from the first receptacle edge. The receptacle surface has a cylindrical grounding hole 54. The grounding hole is provided inwardly from the receptacle surface equally spaced from the left side receptacle edge and the right side receptacle edge in proximity to the second receptacle edge. The receptacle surface has a trapezoidal projection 56. The trapezoidal projection is formed intermediate the left and right receptacles laterally. The trapezoidal projection extends longitudinally from the first receptacle edge to adjacent to the grounding receptacle.

The receptacle includes four rearwardly extending fingers 60. The rearwardly extending fingers are formed with barbed ends and are removably received within a rectilinear receptacle component 62. The rectilinear receptacle component has an upward extension and a downward extension for the passage of screws to facilitate coupling the assembly to a wall.

The authorized receptacle conforms to all standards for design and function requirements for standard NEMA receptacles but with an additional projection to prevent standard NEMA plugs from being inserted. The projection is trapezoidal/wedge shaped. The projection extends down a centerline of the receptacle face. The projection is evenly spaced down the centerline of the receptacle starting at one end of the receptacle face. The projection is 0.570 inches in length. The projection has a base width of 0.240 inches. The projection has a peak width of 0.115 inches. The projection protrudes 0.375 inches from the receptacle surface.

The authorized plug conforms to all standards for design and function requirements for standard NEMA power cords. The authorized plug includes a modification to allow it to be inserted into a standard NEMA receptacle. The authorized plug is modified with the trapezoidal shaped recess extending down a centerline of the plug. The recess is evenly spaced down the centerline of the plug face starting at the one end of the plug head. The recess is 0.500 inches in length. The recess has a base width of 0.250 inches and a peak width of 0.125 inches. The recess is 0.375 inches deep from the face of the plug.

The left and right slots and the grounding hole are adapted to receive the left and right and grounding prong respectively. The trapezoidal recess receives the trapezoidal projection when the authorized electrical receptacle receives the authorized electrical plug. The left and right slots and the grounding hole are prohibited from operatively receiving the left and right and grounding prongs respectively when other than an authorized plug is attempted to be operatively with an authorized receptacle.

Note is taken that the projection is located between the slots with the projection having a first length. The prongs have an essentially equal second length. The depth of the recess and the height of the projection and the first and second lengths are essentially the same plus or minus 20 percent. In this manner, it will not be possible to insert the prongs of an unauthorized electrical plug into the slots of an authorized receptacle and current will not be conducted through the prongs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A receptacle/plug assembly comprising:

an authorized electrical plug having a plug surface with first and second plug edges and left and right side plug edges, the plug surface having left and right prongs projecting outwardly from the plug surface, a recess having a depth formed in the plug surface, the recess having an open front and an open top; and an authorized electrical receptacle having a receptacle surface with first and second receptacle edges the receptacle surface having left and right side receptacle edges, the receptacle surface having left and right slots extending inwardly from the receptacle surface, a projection having a height formed in the receptacle surface, the receptacle surface having supplemental left and right slots extending inwardly from the receptacle surface, a secondary projection having a height formed in the receptacle surface;

wherein the left and right slots and the supplemental left and right slots are adapted to receive the left and right prongs respectively with the recess receiving the projection when an authorized electrical receptacle receives an authorized electrical plug; and wherein each projection is located between associated slots with the projection having a first length, and wherein the prongs have an essentially equal second length, and wherein the depth and the height and the first and second length are essentially the same plus or minus 20 percent, whereby an unauthorized electrical plug will be unable to insert its prongs into the slots of an authorized receptacle for conducting current through the prongs.

2. A receptacle/plug assembly (10) for coupling authorized electrical devices to particular sources of electrical potential while prohibiting the coupling of unauthorized electrical devices to the particular sources of electrical potential, the coupling and the prohibiting being done in a safe, convenient and economical manner, the assembly comprising, in combination:

an authorized electrical device having an electrical line (14) with a terminal end, authorized electrical plug (16) at the terminal end of the electrical line, the authorized electrical plug having a plug surface (18), the plug surface having a first plug edge (10) and a longitudinally spaced second plug edge (22), the plug surface having a left side plug edge (24) and a laterally spaced right side plug edge (26), the plug surface having a generally planar configuration with a left prong (28) projecting outwardly from the plug surface adjacent to and parallel with the left side plug edge in proximity to the first plug edge, a right prong (30) projecting outwardly from the plug surface adjacent to and parallel with the right side plug edge in proximity to the first plug edge, a cylindrical grounding prong (32) projecting outwardly from the plug surface equally spaced from the left side plug edge and the right side plug edge in proximity to the second plug edge, a trapezoidal recess (34) formed in the plug surface intermediate the left and right plugs laterally and extending longitudinally from the first plug edge to adjacent to the grounding plug;

an authorized electrical receptacle (38) operatively coupled to a source of electrical potential the authorized electrical receptacle having a receptacle surface (40), the receptacle surface having a first receptacle edge (42) and a longitudinally spaced second receptacle edge (44), the receptacle surface having a left side receptacle edge (46) and a laterally spaced right side receptacle edge (48), the receptacle surface having a generally planar configuration with a left slot (50) extending inwardly from the receptacle surface adjacent to and parallel with the left side receptacle edge in proximity to the first receptacle edge, a right slot (52) extending inwardly from the receptacle surface adjacent to the parallel with the right side receptacle edge remote from the first receptacle edge, a cylindrical grounding hole (54) extending inwardly from the receptacle surface equally space from the left side receptacle edge and the right side receptacle edge in proximity to the second receptacle edge, a trapezoidal recess (56) formed in the receptacle surface intermediate the left and right receptacles laterally and extending longitudinally from the first receptacle edge to adjacent to the grounding receptacle;

the receptacle surface having a secondary left slot extending inwardly from the receptacle surface adjacent to and parallel with the left side receptacle edge in proximity to the first receptacle edge, a secondary right slot extending inwardly from the receptacle surface adjacent to the parallel with the right side receptacle edge remote from the first receptacle edge, a cylindrical secondary grounding hole extending inwardly from the receptacle surface equally space from the left side receptacle edge and the right side receptacle edge in proximity to the second receptacle edge, a trapezoidal secondary recess formed in the receptacle surface intermediate the secondary left and right receptacles laterally and extending longitudinally from the first receptacle edge to adjacent to the grounding receptacle each recess having an open top above and a grounding hole below;

the authorized receptacle conforming to all standards for design and function requirements for standard NEMA receptacles but with an additional projection to prevent standard NEMA plugs from being inserted, the trapezoidal recess having an open front for receiving a trapezoidal projection, the trapezoidal recess having an open top for viewing a trapezoidal projection, the projection being trapezoidal/wedge shaped and extending down a centerline of the receptacle face, the projection being evenly spaced down the centerline of the receptacle starting at one end of the receptacle face, the projection being 0.570 inches in length with a base width of 0.240 inches and a peak width of 0.115 inches, the projection protruding 0.375 inches form the receptacle surface;

the authorized plug conforming to all standards for design and function requirements for standing NEMA power cords with a modification to allow it to be inserted into a standard NEMA receptacle, the authorized plug being modified with the trapezoidal shaped recess extending down a centerline of the plug, the recess being evenly spaced down the centerline of the plug face starting at the one end of the plug head, the recess being 0.500 inches in length with a base width of 0.250 inches and a peak width of 0.125 inches, the recess being 0.375 inches deep from the face of the plug; and the left and right slots and the grounding hole adapted to receive the left and right and grounding prong respectively with the trapezoidal recess receiving the trapezoidal projection when the authorized electrical receptacle receives the authorized electrical plug, the left and right slots and the grounding hole being prohibited from operatively receiving the left and right and grounding prongs respectively when other than authorized plug is attempted to be operatively with the authorized receptacle.

* * * * *